United States Patent [19]

Murata et al.

[11] 3,950,627

[45] Apr. 13, 1976

[54] PUSH BUTTON SWITCH

[75] Inventors: Minoru Murata, Yokohama; Yuji Harada, Tokyo, both of Japan

[73] Assignee: Canon Kabushiki Kaisha, Tokyo, Japan

[22] Filed: Sept. 17, 1973

[21] Appl. No.: 397,803

[30] Foreign Application Priority Data

| | | |
|---|---|---|
| Sept. 26, 1972 | Japan | 47-111678[U] |
| Sept. 26, 1972 | Japan | 47-111679[U] |
| Sept. 26, 1972 | Japan | 47-111680[U] |
| Sept. 26, 1972 | Japan | 47-111681[U] |
| Sept. 26, 1972 | Japan | 47-111682[U] |
| Sept. 26, 1972 | Japan | 47-111683[U] |
| Sept. 21, 1972 | Japan | 47-94893 |

[52] U.S. Cl. ..... 200/159 R; 200/264

[51] Int. Cl.[2] ..... H01H 13/52

[58] Field of Search ..... 200/159 B, 159 R, 340, 200/302, 264

[56] References Cited

UNITED STATES PATENTS

| | | | |
|---|---|---|---|
| 3,379,851 | 4/1968 | Weremy | 200/159 R |
| 3,735,058 | 5/1973 | Berry | 200/276 X |
| 3,818,153 | 6/1974 | Arvai | 200/159 B X |

*Primary Examiner*—G. Z. Rubinson
*Assistant Examiner*—William J. Smith
*Attorney, Agent, or Firm*—Fitzpatrick, Cella, Harper & Scinto

[57] ABSTRACT

A push button switch comprises a key top having a recess and a resilient member provided so as to surround the recess of the key top. The resilient member has a projected portion extending therefrom in the direction away from the recess of the key top, and at least the end of the projected portion is formed of conductive material. A contact member is secured to a base plate in opposed relationship with the projected portion. A holder member holds the key top in such a manner that the projected portion of the resilient member is normally spaced apart from the contact member but engages the contact member upon depression of the key top.

54 Claims, 15 Drawing Figures

PUSH BUTTON SWITCH

BACKGROUND OF THE INVENTION

1. Field of the Invention

This invention relates to a push button switch, and more particularly to a push button switch suitable for use as signal input means in electronic desk-top calculators or the like.

2. Description of the Prior Art

Reed key switches have been widely used as signal input means in electronic desk-top calculators or the like. Such a reed key switch comprises a permanent magnet movable in response to movement of a key top, and a reed switch securely fixed to a member which is unaffected by movement of the key top (the reed switch comprises two reeds of magnetically conductive material led out of the opposite ends of a hermetically sealed cylindrical tube of glass or other magnetically non-conductive material, the free ends of the reeds disposed within the hermetically sealed tube in the center portion thereof being parallel and adjacent to each other).

The reed key switch is operable such that, when the key top is depressed, the permanent magnet is moved to cause the magnetic flux therefrom to pass through the reeds of the reed switch to attract the reeds into contact with each other. Thus, depression of the key top results in formation of a current flow path between the two reeds of the reed switch. As the key top is released from depression, the magnet is moved to liberate the reeds from its magnetic flux and disengage the reeds from each other, thus breaking the current flow path formed between the two reeds.

The reed key switch having the construction and performance as described above enjoys good durability and high reliability because the reeds acting as contacts are housed within the hermetically sealed container and driven not directly by mechanical means, whereas the reed key switch is relatively large-sized in proportion to the large size of the reed switch and of the magnet, and the resultant higher cost of manufacture limits the applications of such switch.

To overcome the above-noted disadvantages of such push button switches, conductive rubber keys are known which employ conductive rubber as bridge means (the conductive rubber is composed of rubber with a conductive material distributed therein). In such a key, conductive rubber is secured to the lower portion of a key top and a pair of contacts is secured to a based plate in opposed and predetermined spaced relationship with the conductive rubber. Depression of the key top brings the conductive rubber into engagement with the pair of contacts to thereby form a current flow path between the two contacts, and release of the pressure from the key top returns the key top to its original position and brings the conductive rubber out of engagement with the pair of contacts, thereby breaking the current flow path formed between the contacts.

This type of key switch is simple to construct and economical to manufacture and permits reduction in thickness or size, but the very short stroke of the key top and especially, the very short distance over which the key top is moved after the conductive rubber has engaged the pair of contacts, has not only made it difficult for the operator's finger to feel and judge whether the switch has assumed its ON position in response to the pressure imparted thereto by the finger, but also led to the possibility that any slightest vibration of the finger as it depresses the key top results in unstable opening-closing of the switch.

SUMMARY OF THE INVENTION

It is therefore an object of the present invention to provide a compact push button switch which is simple to construct and economical to manufacture.

It is another object of the present invention to provide a push button switch whose stroke before driven and whose stroke after driven may be freely selected.

It is still another object of the present invention to provide a push button switch which has a small thickness for its stroke.

It is yet another object of the present invention to provide a push button switch which employs a reduced number of parts.

It is yet still another object of the present invention to provide a push button switch whose contact or contacts are protected against contamination.

Other objects and advantages of the present invention will become fully apparent from the following detailed description of various embodiments taken in conjunction with the accompanying drawings.

DESCRIPTION OF THE PREFERRED EMBODIMENTS

Figure 1:
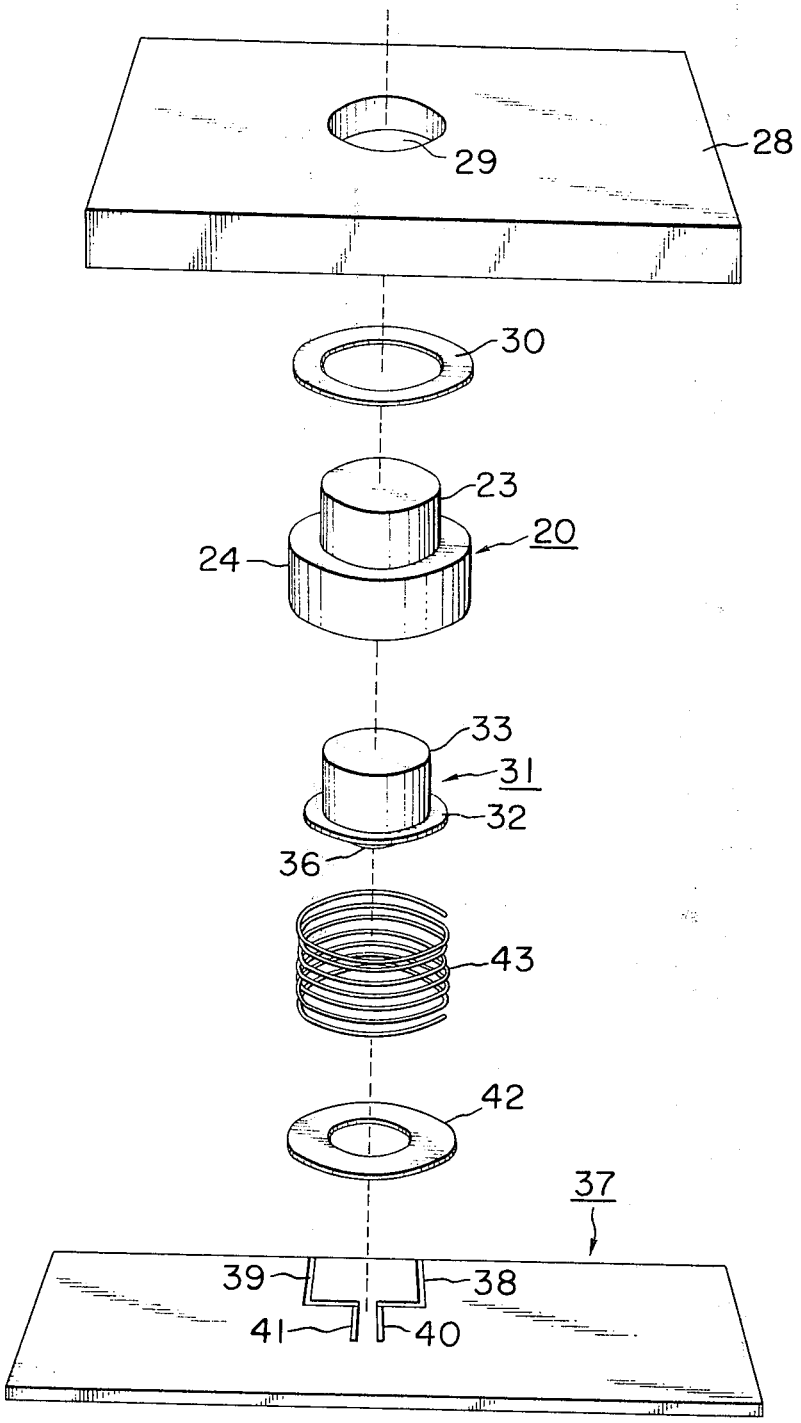
FIGS. 1 to 4 show an embodiment of the push button switch according to the present invention, FIG. 1 being an exploded perspective view, FIG. 2 being a cross-sectional side view of the switch before driven, FIG. 3 being a perspective view corresponding to FIG. 2, and FIG. 4 being a cross-sectional side view of the switch when driven.
Figure 2:
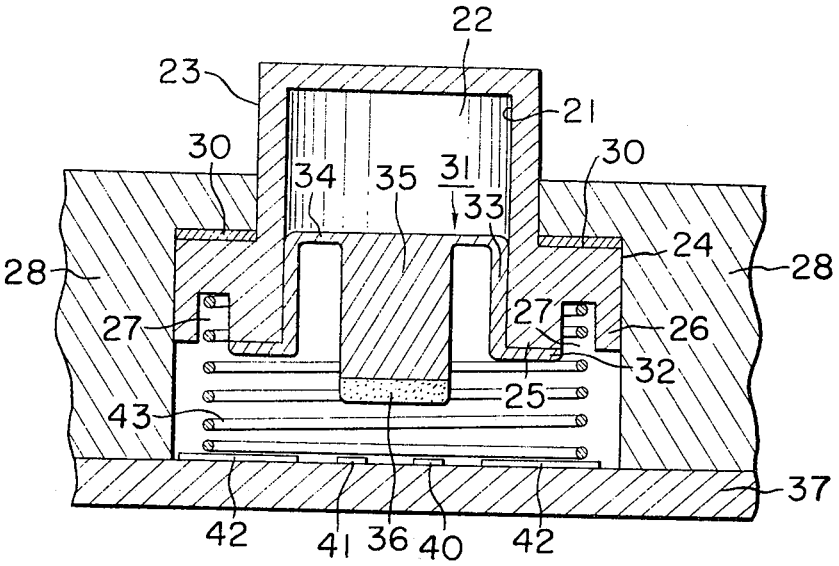
Figure 3:
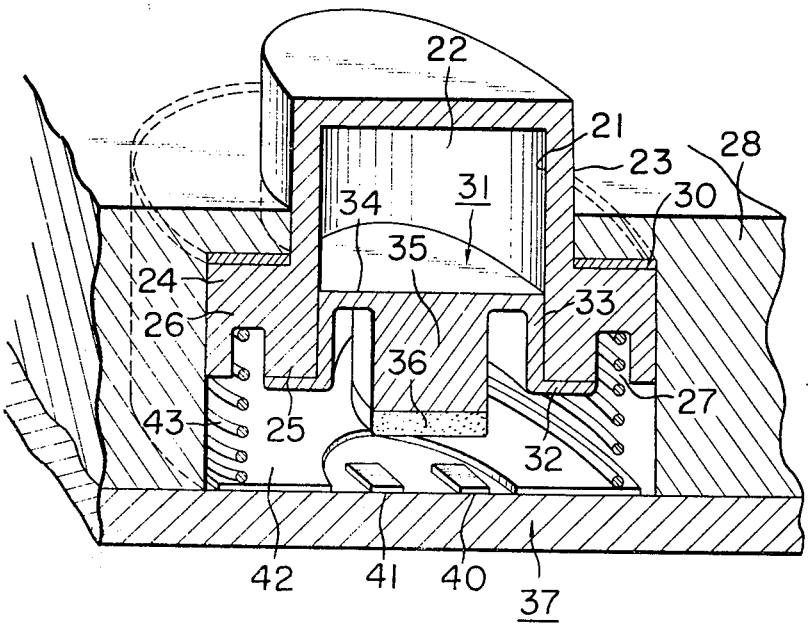

Referring to FIGS. 1 to 3, there is shown a first embodiment of the push button switch according to the present invention. A key top, generally designated by 20, is formed of insulative material such a synthetic resin or the like and downwardly movable upon application of extraneous force thereto by a finger or the like, and has an inner wall 21 cylindrically shaped to define a recess or hollow 22 within the key top. The key top comprises a cylindrical operating portion 23 forming the upper part thereof, a flange portion 24 forming the lower part thereof and extending laterally outwardly from the upper part, and inner and outer concentric, annular projections 25 and 26 extending downwardly from the flange portion 24 and spaced apart from each other to define an annular groove 27 therebetween.

A holder member for slidably holding the key top 20 is designated by 28 and has a lower part forming a guide portion configured substantially complementarily to the configuration of the flange portion 24, and an upper part providing a retaining portion formed with an aperture 29 configured substantially complementarily to the configuration of the cylindrical operating portion 23 to prevent upward slippage of the key top. The key top 20 may be inserted into the aperture 29 from therebelow with a shock absorbing member 30 of felt or sponge interposed between the holder member and the key top, the shock absorbing member being configured substantially complementarily to the upper surface of the flange portion 24. Generally designated by 31 is a resilient member of synthetic rubber or like material which includes an annular flange portion 32 complementary to the bottom of the inner annular projection 25 of the key top, a cylindrically shaped side wall 33 adapted to be disposed in resilient contact with the inner wall 21 of the key top, a top surface portion 34 integral with the side wall 33, and a projection 35 downwardly extending from the top surface portion 34 and having a conductor portion 36 of conductive material such as conductive rubber or the like attached to the lower end face of the projection 35 so as to form a part of such projection. The resilient member 31 may be formed by using resilient material such as conductive rubber or the like for the whole of the member, or by using such material only for the projection 35, or by attaching a foil of metal to the lower end face of the projection.

The resilient member 31 may be securely fixed to the key top by bonding the annular flange 32 of the member 31 to the bottom surface of the inner annular projection 25 of the key top. The lower surface of the conductor portion 36 forming a part of the projection 35 is normally positioned at a level below the lower surface of the annular flange 32 and movable up to the level flush with said lower surface of the annular flange 32. A base plate, generally designated by 37, is formed of an insulative material such as synthetic resin or the like and the surface thereof opposed to the key top is formed with a circuit of conductive foil or the like. In the illustrated embodiment, there is a pair of current flow paths 38 and 39 through which current flows upon short-circuiting, and the closely facing portions of these current flow paths 38 and 39 provide contacts 40 and 41 which are spaced apart by a distance less than the diameter of the conductor portion 36. Designated by 42 is an insulating sheet of synthetic resin or like material having an outer diameter larger than that of a coil spring 43 to be described, but smaller than that of the annular groove 27 in the key top, and having an inner diameter larger than the outer diameter of the conductor portion 36. The coil spring 43 is designed for insertion in the annular groove 27 formed in the key top.

In assembly, the key top 20 with the resilient member 31 secured thereto is inserted into the aperture 29 of the holder member 28 from therebelow with the shock absorbing member 30 interposed between the key top and the holder member, whereafter the base plate 37 carrying the coil spring 43 thereon is placed so that the coil spring 43 is received in the annular groove 27 of the key top 20, and then the holder number 28 and the base plate 37 are secured to each other. There is thus provided a push button switch assembly wherein the key top is normally biased upwardly by the coil spring 43 to keep the conductor portion 36 off the contacts 40 and 41, as shown in FIG. 2, thereby electrically disconnecting the current flow paths 38 and 39 from each other.

In the push button switch of such construction, when the key top is downwardly depressed as by a finger against the coil spring 43, the resilient member 31 is moved down with the key top while maintaining its original configuration as shown in FIG. 2 until the conductor portion 36 forming the end of the projection 35 is engaged with the contacts 40 and 41, but once the engagement of the conductor portion 36 with the contacts 40 and 41 has occurred, the depression force exerted on the key top is absorbed by the resilient member 31. Thus, the downward force on the key top is transferred through the annular flange 32, the cylindrical side wall 33, the top surface portion 34 and the projection 35 to the conductor portion 36 and therefore, further depression of the key top results in expansion of the cylindrical side wall 33 and top surface portion 34, deformation of the bend portion formed between the side wall 33 and the top surface portion 34, and compression of the projection 35 and conductor portion 36. Under such conditions, more or less vibrations of the finger or the like as it depresses the key top would be absorbed by the resilient member to thereby maintain the conductor portion in engagement with the contacts, thus preventing occurrence of chattering, bouncing or like phenomenon.

More particularly, depression of the key top causes the projection 35 to be compressed and urged against the contacts, and when the depression force exceeds a predetermined level, the shoulder formed by the cylindrical side wall 33 and top surface portion 34 of the resilient member will be deformed while such depression force is absorbed into an expansion of the side wall 33 and top surface portion 34, thereby preventing the conductor portion at the lower end of the projection from being subjected to any excessive force. This is useful to permit a greater stroke for the key top.

It will be noted that the deformation of the resilient member occurs toward the hollow space surrounded by the inner wall 21 of the key top and the resilient member 31 in such a manner that the resilient member intrudes into the hollow space, and this means an effective utilization of the interrior space within the key top, which in turn leads to the elimination of the need that any particular space for accomodating the depression of the resilient member be provided in any other part of the switch than the key top. Thus, a plurality of such push button switches may be arrayed on a keyboard with their key tops closely adjacent to one another.

Figure 4:
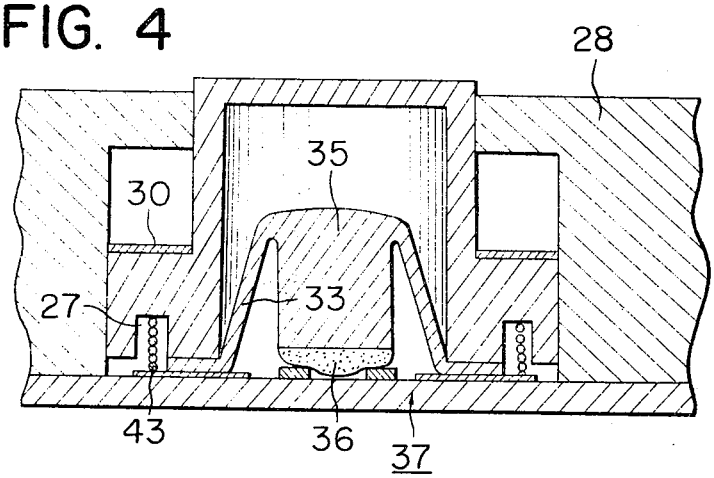

When the key top is further depressed from the above-described position, the lower surface of the annular flange 32 of the resilient member 31 bears against the insulating sheet 42 on the base plate 37 in the manner as shown in FIG. 4, and this serves as a stop means which prevents the resilient member from being broken or damaged by any excessive depression force exerted on the key top, thus obviating occurrence of failures of the switch.

Also, such stop means is such that the resilient member intervenes between the key top and the base plate so as to protect the base plate against damage or the like.

In the above-described embodiment, the annular flange 32 of the resilient member 31 is secured to the bottom of the inner annular projection 25 of the key top in a gas-tight manner to thereby form a hermetically sealed space between the inner wall 21 of the key top and the resilient member 31. Such hermetically sealed space is compressible during depression of the key top to absorb the depression force with the resilient member. Where such a hermetically sealed space defined by the inner key top wall and the resilient member is undesirable for some reason or other, such space may be vented to the atmosphere through a gas passage formed as shown in FIGS. 5 and 6.

Figure 5:
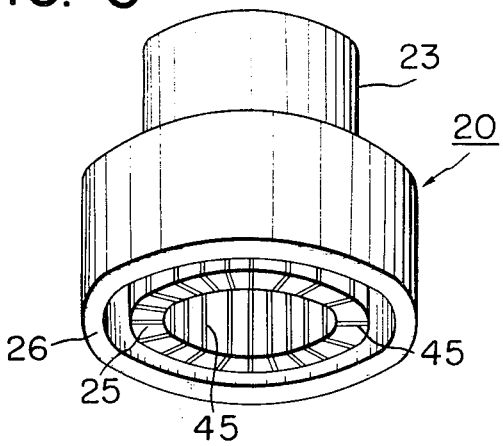
FIGS. 5 to 6 show another embodiment of the push button switch according to the present invention, FIG. 5 being a perspective view of the key top in this embodiment and FIG. 6 being a cross-section of the push button key with the key top of FIG. 5 when it is driven.
Figure 6:
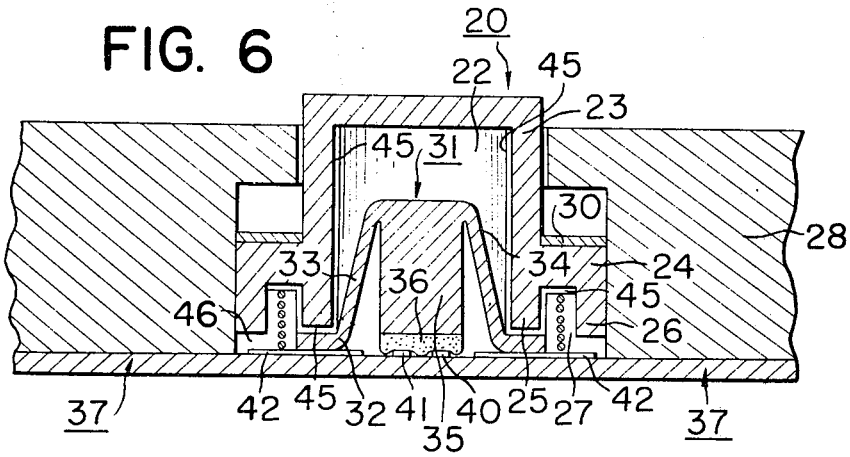

FIGS. 5 and 6 illustrate an embodiment of the present invention in which said space formed by the inner key top wall and the resilient member is not hermetically sealed. In the embodiment, grooves 45 for connecting the space between the inner key top wall 21 and the resilient member 31 to an outer space 46 are provided in and around the portion of the key top which is in contact with the resilient member, and more specifically, in the inner wall 21, in the peripheral portion of the inner annular projection 25, and in the bottom of the annular groove 27.

Such grooves 45 permit the gases in the space between the inner key top wall 21 and the resilient member 31 to be discharged into the outer space 46 when the pressure of such gases exceeds the atmospheric pressure upon depression of the key top, and permit the gases in the outer space to flow back into the first-named space when the key top is lifted by the force of the spring, thereby maintaining the gas pressure in the first-named space at a level equal to the atmospheric pressure.

The provision of such grooves between the key top and the resilient member permits the key to be designed with the operation of the resilient member alone taken into consideration.

Figure 7:
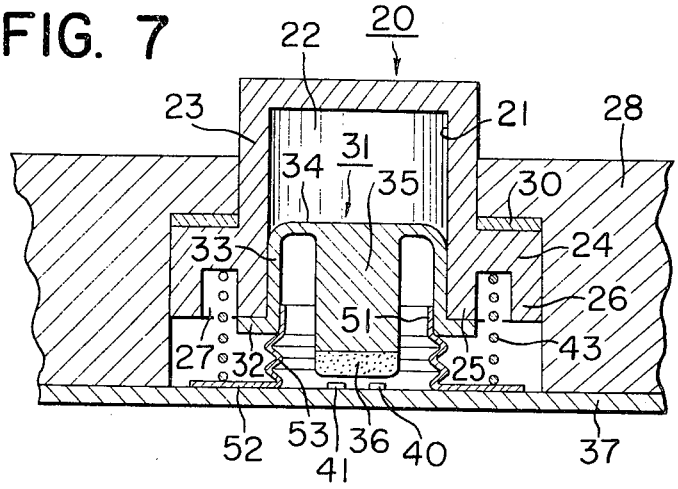
FIGS. 7 to 8 illustrate still another embodiment of the push button switch according to the present invention, FIG. 7 being a cross-sectional side view of such switch before driven and FIG. 8 being a perspective view of the dust-proof film shown in FIG. 7.

FIG. 7 shows an embodiment of the present invention in which the push button switch shown in FIGS. 1 to 4 is provided with a dust-proof film for preventing the contacts of the switch from being contaminated with dust or other foreign materials.

In the push button switch of FIGS. 1 to 4, dust or other foreign materials may intrude into the neighborhood of the contacts through the gap between the key top and the holder member to contaminate the contacts or the conductor portion until the switch becomes unable to produce normal electrical signals during years of use thereof. In the push button switch shown in FIG. 7, such undesirable intrusion of dust or other foreign materials may be avoided by additionally providing a dust-proof film on the push button switch of FIGS. 1 to 4. In FIG. 7, those members designated by reference numerals similar to those in FIGS. 1 to 4 are similar in operation and function to those members of FIGS. 1 to 4 and these need not be described further.

Figure 8:
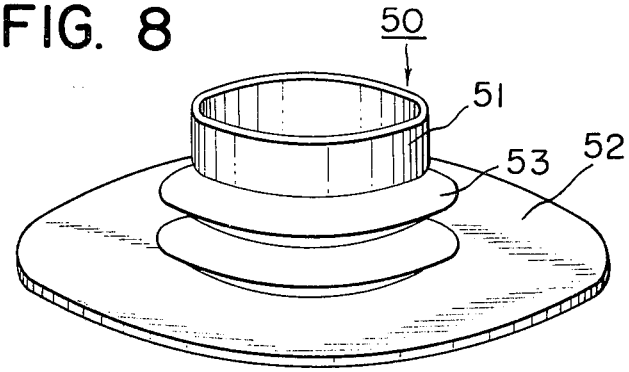

As illustrated in FIG. 8, a dust-proof film is interposed between the resilient member and the base plate to prevent entry of dust or other foreign materials. The dust-proof film, designated by 50 in FIG. 8, is formed of a highly flexible material and the upper portion thereof comprises a cylindrical portion 51 having an outer diameter equal to the inner diameter of the cylindrical side wall 33 of the resilient member 31. The bottom portion of the dust-proof film comprises a flange 52 whose outer diameter is larger than the diameter of the coil spring 43 and whose surface is substantially parallel to the base plate 37. Bellows 53 is provided between the cylindrical portion 51 and the flange 52 to facilitate the vertical expansion and contraction of the dust-proof film 50.

Such dust-proof film 50 has its cylindrical portion 51 secured to the cylindrical side wall 33 of the resilient member 31 and has its flange 52 secured to the base plate 37. The dust-proof film 50 may be formed of non-conductive material, thus eliminating the insulating sheet 42 shown in FIGS. 1–4.

With the dust-proof film secured in the described manner, the contacts 40, 41 and the conductor portion 36 are located within the hermetically sealed space defined by the resilient member 31, the dust-proof film 50 and the base plate 37, so that no dust or other foreign materials cannot enter into the interior of the push button switch.

Figure 9:
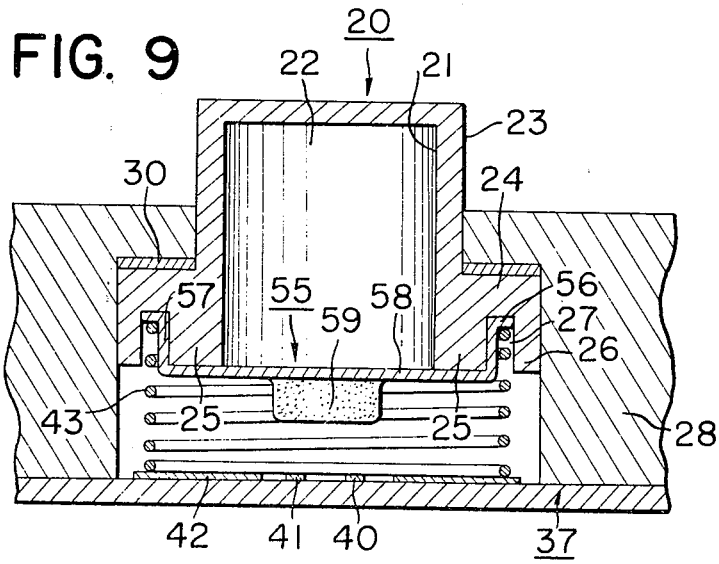
FIGS. 9 to 10 show a further embodiment of the push button switch according to the present invention, FIG. 9 being a cross-sectional view of such switch before driven and FIG. 10 being a similar view of the switch when driven.
Figure 10:
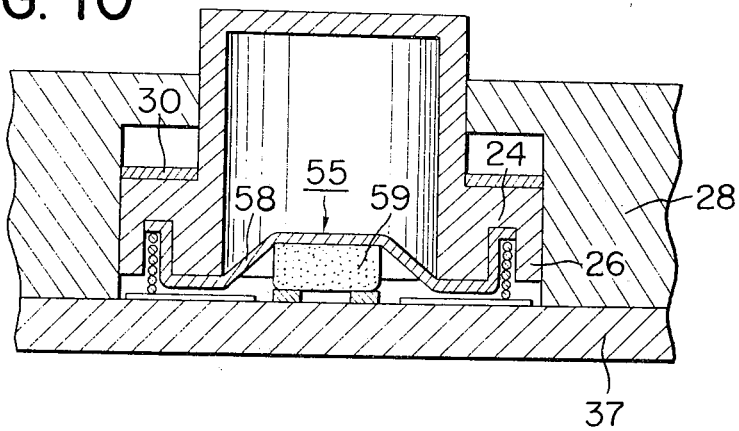

FIGS. 9 and 10 show a further embodiment of the present invention which is identical with the embodiment of FIGS. 1–4 in every resepct except the configuration of the resilient member, so that similar parts are designated by similar reference numerals and their detailed description is ommited herein.

In the present embodiment, the resilient member is generally designated by 55 and includes an annular portion 56 configured complementarily to the bottom of the annular groove 27 in the key top 20, a side wall 57 bearing against the outer side wall of the inner annular projection 25, a bottom surface portion 58 flattened so as to abut with the bottom of said inner annular projection 25, and a projection 59 formed of conductive rubber or like material and secured to the bottom surface portion 58 substantially in the center thereof in opposed relationship with the contacts 40 and 41 provided on the base plate.

Such resilient member 55 is normally positioned with the annular portion 56 bearing against the bottom of the annular groove 27 and with the coil spring 43 interposed between the key top 20 and the base plate 37, the upper end of the spring bearing against the annular portion 56. Thus, the resilient member is fixed with respect to the key top with the aid of the biasing force of the coil spring to such a degree that any additional securing means such as adhesive or the like need not be employed to secure the key top and the resilient member to each other. Also the fact that one end of the coil spring bears against the key top with the resilient member interposed therebetween prevents occurrence of noises or the like which would otherwise result from the friction between the spring and the key top. It will be apparent that the resilient member 55 may be formed of conductive rubber in its entirety.

When the key top of the push button switch is depressed from its normal position as shown in FIG. 9 (the position in which the key top is subjected to no extraneous force), the resilient member is moved down while maintaining its condition as shown in FIG. 9 until the projection 59 engages the contacts on the base plate, but continued depression of the key top after the engagement causes deformation and expansion of the bottom surface portion 58 as shown in FIG. 10 by absorbing most of such depression force exerted on the key top.

Figure 11:
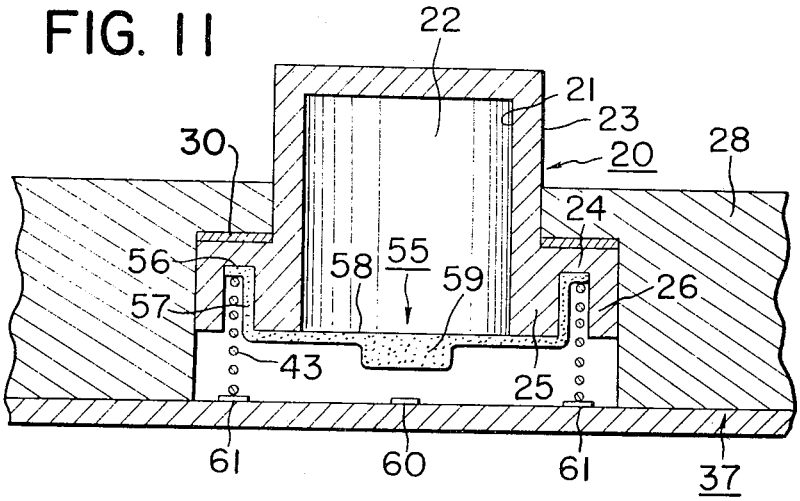
FIG. 11 is a side view, in cross-section, of the push button switch according to a further embodiment of the present invention and showing the switch before driven.

FIG. 11 illustrates still a further embodiment of the present invention in which the conductor portion does not short-circuit two contacts, but instead, a single contact is provided on the base plate and may be engaged by the conductive rubber to thereby form a current flow path. In FIG. 11, key top 20, holder member 28, shock absorbing member 30, resilient member 55 and coil spring 43 are similar to those described with respect to FIGS. 1 to 10 and need not be described further. However, the resilient member 55 in the present embodiment is formed of conductive rubber in its entirety. A single contact 60 is provided on the base plate 37 at a location corresponding to the conductor portion 59 and an electrode 61 is also provided on the base plate at a location where the coil spring 43 is seated. Therefore, by forming the coil spring 43 of a metal or like conductive material, there may be formed a conduction path leading from the electrode 61 through the coil spring 43 to the resilient member 55. Thus, when the key top 20 is depressed to bring the projection 59 into connection with the contact 60, there is provided a current flow path between the contact 60 and the electrode 61 which is suitable for use as a switch.

Figure 12:
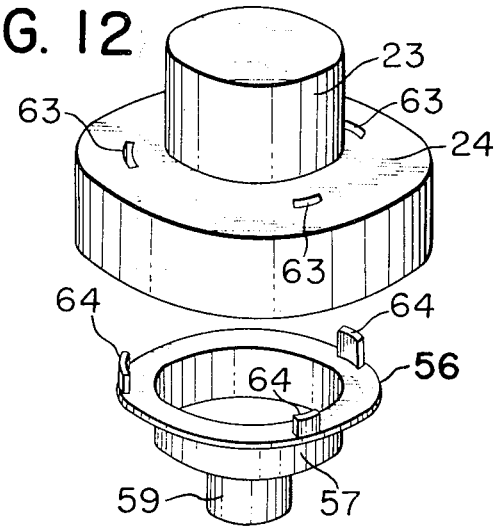
FIGS. 12 and 13 illustrate still a further embodiment of the push button according to the present invention, FIG. 12 being a perspective view of its key top and resilient member, and FIG. 13 being a cross-sectional side view of the switch before driven.
Figure 13:
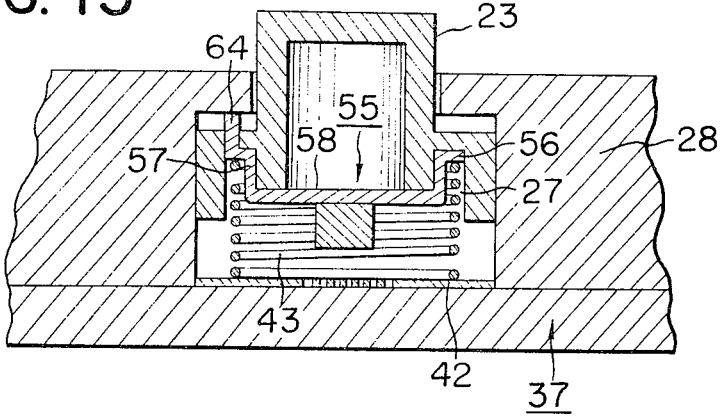

FIGS. 12 and 13 show an embodiment in which the shock absorbing member interposed between the key top and the holder member is provided by the resilient member. Herein, three holes 63 are formed through the bottom of the annular groove 27 provided in the flange 24 of the key top 20 similar to that shown in FIGS. 9 and 10, and three upright extensions 64 extend from the annular portion 56 of the resilient member 55 so as to correspond to the three holes 63. When the resilient member 55 is fixed to the key top 20, the upright extensions 64 pass through the corresponding holes 63 up to the level flush with the upper surface of the flange 24.

Thus, in the normal position of the push button switch, the extensions 64 formed of a resilient material are in contact with the holder member 28 to thereby prevent direct contact between the key top and the holder member which would otherwise occur during the return of the key top to its normal position.

Figure 14:
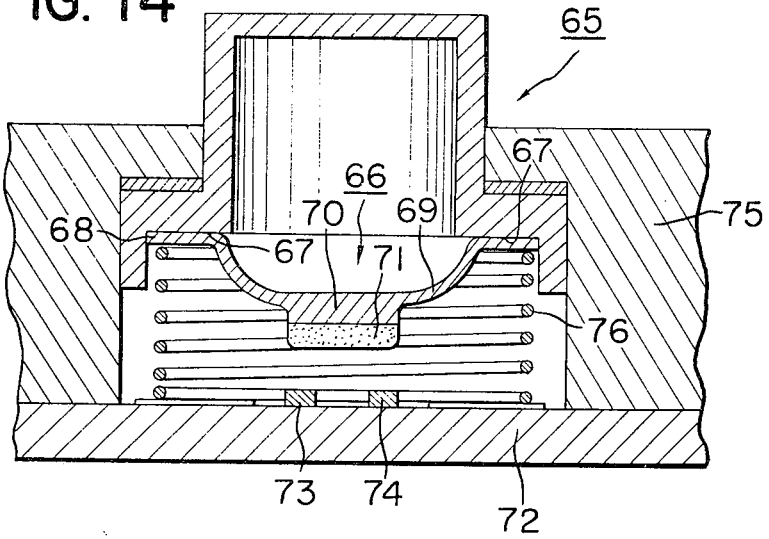
FIGS. 14 and 15 show yet a further embodiment of the push button according to the present invention, FIG. 14 being a cross-sectional side view of such switch before driven and FIG. 15 being a similar view of the switch when driven.
Figure 15:
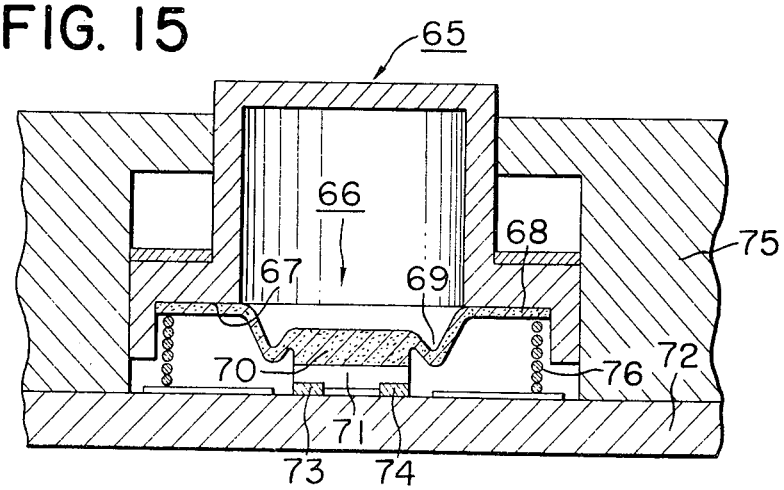

FIGS. 14 and 15 illustrate a further embodiment of the push button switch according to the present invention, in which resilient member 66 fixed to the underside of key top 65 is of downwardly convex configuration. More specifically, this resilient member 66 comprises an annular portion 68 complementary to the underside of the key top 67, a downwardly curved portion 69, a downwardly extending projection 70 formed in the center of the curved portion 69, and a conductor portion 71 attached to the lower end of the projection 70. In such resilient member, of course the conductor portion 71 or the other portions or the entire body may be formed of conductive rubber.

The resilient member 66 is adhesively or otherwise secured to the underside of key top 65, which in turn is fixed by holder member 75 in such a manner that the conductor portion 71 is opposed to two contacts 73, 74 provided on base plate 72 which are to be short-circuited. Coil spring 76 is disposed between the resilient member secured to the key top and the base plate so as to bias the key top upwardly. Depression of such key top causes the resilient member 66 to move down while maintaining its configuration as shown in FIG. 14 until the conductor portion 71 engages the contacts 73, 74, but once the engagement has occurred between the conductor portion 71 and the contacts 73, 74, the downward movement of the key top causes the curved portion 69 to be deformed into the configuration as shown in FIG. 15, where the curved portion 69 assumes a downwardly projected configuration. Inasmuch as the curved portion 69 is capable of assuming such a deformed shape, depression of the key top after the engagement of the conductor portion 71 with the contacts 73 and 74 will only require application of a reduced force which is sufficient to bring about deformation of the resilient member, and this leads to the provision of a push buttom switch which is operable by light touch therewith.

We claim:

1. A push button switch comprising:
   a key top adapted to be applied with an external force, said key top having a recess therein;
   a resilient member arranged to cover the recess, said resilient member having a projection extending therefrom in a direction opposite to the depth of the recess, at least an end of the projection being of conductive material;
   the opening of the recess being of such dimension that at least a portion of the projection is passable through the opening;
   a contact member secured to a base plate in opposed relationship with said projected portion; and
   means, disposed outwardly of said contact member, for urging said key top in such a manner that the projection of said resilient member is spaced apart from said contact member when no external force is applied to said key top and that the projection of said resilient member engages the contact member when an external force is applied to said key top.

2. A switch according to claim 1, wherein the recess is provided at the center of said key top.

3. A switch according to claim 1, wherein the recess is of circular cross section, and the projection is disposed in alignment with the circle of the recess.

4. A switch according to claim 1, wherein said resilient member is of sheet-like form.

5. A switch according to claim 1, wherein the projection is of conductive rubber.

6. A switch according to claim 1, further comprising an insulating sheet disposed between said urging means and the base plate, and having an opening at a position corresponding to the contact member.

7. A push button switch comprising:
   a key top adapted to be applied with an external force, said key top having a recess therein;
   a resilient member arranged to cover the recess, said resilient member having a projection extending therefrom in a direction opposite to the depth of the recess, at least an end of the projection being of conductive material;
   the opening of the recess being of such dimension that at least a portion of the projection is passable through the opening;

a plurality of contact members secured to a base plate in opposed relationship with said projected portion; and means, disposed outwardly of said contact members, for urging said key top in such a manner that the projection of said resilient member is spaced apart from said contact members when no external force is applied to said key top and that the projection of said resilient member engages the contact member when an external force is applied to said key top.

8. A push button switch comprising:

a key top adapted to be applied with an external force, said key top having a recess therein;

a resilient member arranged to cover the recess, said resilient member having a projection extending therefrom in a direction opposite to the depth of the recess, at least an end of the projection being of conductive material;

a contact member secured to a base plate in opposed relationship with said projected portion; and means for urging said key top in such a manner that the projection of said resilient member is spaced apart from said contact member when no external force is applied to said key top and that the projection of said resilient member engages the contact member when an external force is applied to said key top, said urging means including a spring arranged to surround said contact member.

9. A push button switch comprising:

a key top adapted to be applied with an external force, said key top including a recess therein and a flange extending therearound, said flange having an annular groove;

a resilient member arranged to cover the recess, said resilient member having a projection extending therefrom in a direction opposite to the depth of the recess, at least an end of the projection being of conductive material;

a contact member secured to a base plate in opposed relationship with said projected portion; and means for urging said key top in such a manner that the projection of said resilient member is spaced apart from said contact member when no external force is applied to said key top and that the projection of said resilient member engages the contact member when an external force is applied to said key top, said urging means being disposed between the annular groove and the base plate.

10. A switch according to claim 9, wherein said urging means includes a coil spring.

11. A switch according to claim 9, further comprising a retaining member having means for stopping the movement of the key top away from the base plate.

12. A switch according to claim 9, wherein said spring extends into the groove of the flange.

13. A switch according to claim 9, further comprising an insulating sheet disposed between said urging means and the base plate, and having an opening at a position corresponding to the contact member.

14. A push button switch comprising:

a key top adapted to be applied with an external force, said key top having a recess therein;

a resilient member arranged to cover and extend into the recess, said resilient member having a projection extending, from the portion of said resilient member extended into the recess, in a direction opposite to the depth of the recess, at least an end of the projection being of conductive material;

the opening of the recess being of such dimension that at least a portion of the projection is passable through the opening;

a contact member secured to a base plate in opposed relationship with said projected portion; and means for urging said key top in such a manner that the projection of said resilient member is spaced apart from said contact member when no external force is applied to said key top and that the projection of said resilient member engages the contact member when an external force is applied to said key top.

15. A switch according to claim 14, wherein the recess is provided at the center of said key top.

16. A switch according to claim 14, wherein the recess is of circular cross section, and the projection is disposed in alignment with the circle of the recess.

17. A switch according to claim 14, wherein said urging means surrounds said projection.

18. A switch according to claim 14, further comprising an insulating sheet disposed between said urging means and the base plate, and having an opening at a position corresponding to the contact member.

19. A push button switch comprising:

a key top adapted to be applied with an external force, said key top including a recess therein and a flange extending therearound, said flange having an annular groove;

a resilient member arranged to cover and extend into the recess, said resilient member having a projection extending, from the portion of said resilient member extended into the recess, in a direction opposite to the depth of the recess, the projection extending beyond an opening of the recess, and at least an end of the projection being of conductive material;

a contact member secured to a base plate in opposed relationship with said projected portion; and means for urging said key top in such a manner that the projection of said resilient member is spaced apart from said contact member when no external force is applied to said key top and that the projection of said resilient member engages the contact member when an external force is applied to said key top, said urging means being disposed between the annular groove and the base plate.

20. A switch according to claim 19, wherein said urging means includes a coil spring.

21. A switch according to claim 19, further comprising a retaining member having stopper means for stopping the movement of the key top away from the base plate.

22. A switch according to claim 19, wherein said spring extends into the groove of the flange.

23. A switch according to claim 19, further comprising an insulating sheet disposed between said urging means and the base plate, and having an opening at a position corresponding to the contact member.

24. A push button switch comprising:

a key top adapted to be applied with an external force, said key top having a recess therein;

a resilient member arranged to cover the recess, said resilient member having a projection extending therefrom in a direction opposite to the depth of the recess, at least an end of the projection being of conductive material;

the opening of the recess being of such dimension that at least a portion of the projection is passable through the opening;

a contact member secured to a base plate in opposed relationship with said projected portion; and means, disposed outwardly of said contact member, for urging said key top in such a manner that the projection of said resilient member is spaced apart from said contact member when no external force is applied to said key top and that the projection of said resilient member engages the contact member when an external force is applied to said key top through said resilient member.

25. A switch according to claim 24, wherein said urging means includes a coil spring.

26. A switch according to claim 24, wherein said urging means surrounds said projection.

27. A switch according to claim 24, further comprising an insulating sheet disposed between said urging means and the base plate, and having an opening at a position corresponding to the contact member.

28. A push button switch comprising:

a key top adapted to be applied with an external force, said key top having therein a recess provided with an annular groove, and also having a flange extending therearound;

a resilient member arranged to cover the recess and extend to the groove, said resilient member having a projection extending therefrom in a direction opposite to the depth of the recess, at least an end of the projection being of conductive material;

a contact member secured to a base plate in opposed relationship with said projected portion; and means, disposed outwardly of said contact member, for urging said key top in such a manner that the projection of said resilient member is spaced apart from said contact member when no external force is applied to said key top and that the projection of said resilient member engages the contact member when an external force is applied to said key top, said urging means being disposed between said resilient member within the annular groove and the base plate.

29. A switch according to claim 28, wherein said urging means includes a coil spring the diameter of which is substantially the same as that of the annular groove.

30. A switch according to claim 28, further comprising an insulating sheet disposed between said urging means and the base plate, and having an opening at a position corresponding to the contact member.

31. A push button switch comprising:

a key top adapted to be applied with an external force, said key top including a recess therein and a flange extending therearound;

a resilient member arranged to cover the recess, said resilient member having a projection extending therefrom in a direction opposite to the depth of the recess and beyond the opening of the recess, at least an end of the projection being of conductive material;

a contact member secured to a base plate in opposed relationship with said projected portion;

means, disposed outwardly of said contact member, for urging said key top in such a manner that the projection of said resilient member is spaced apart from said contact member when no external force is applied to said key top and that the projection of said resilient member engages the contact member when an external force is applied to said key top; and a retaining member having stopper means for stopping the movement of the key top away from the base plate, by engaging the flange;

said resilient member having an extension thereon extending to a portion of the flange corresponding to said retaining member.

32. A switch according to claim 31, wherein said flange has an annular groove through which said extension of said resilient member extends.

33. A switch according to claim 31, wherein said extension of said resilient member has three projections.

34. A switch according to claim 31, wherein said urging means surrounds said projection.

35. A push button switch comprising:

a key top adapted to be applied with an external force, said key top having a recess therein, a resilient member arranged to cover the recess, said resilient member having a projection extending therefrom in a direction opposite to the depth of the recess, at least an end of the projection being of conductive material;

the opening of the recess beng of such dimension that at least a portion of the projection is passable through the opening;

a contact member secured to a base plate in opposed relationship with respect to said projected portion; and means disposed outwardly of said contact member, for urging said key top in such a manner that the projection of said resilient member is spaced apart from said contact member when no external force is applied to said key top and that the projection of said resilient member engages the contact member when an external force is applied to said key top;

said resilient member having an extension thereof around the recess arranged to limit the movement of said key top toward the base plate.

36. A switch according to claim 35, wherein said urging means surrounds said projection.

37. A switch according to claim 35, wherein said key top has a flange extending around the recess, said flange having an annular groove to provide a projection between the groove and said recess, and a portion of said resilient member extending to the annular projection to form a stopper.

38. A switch according to claim 37, wherein said urging means is disposed between the base plate and the annular groove.

39. A push button switch comprising:

a key top adapted to be applied with an external force, said key top having a recess therein;

a resilient member arranged to cover the recess, said resilient member having a projection extending therefrom in a direction opposite to the depth of the recess, at least one end of the projection being of conductive material;

the opening of the recess being of such dimension that at least a portion of the projection is passable through the opening;

a contact member secured to a base plate in opposed relationship with respect to said projected portion; and means, disposed outwardly of said contact member, for urging said key top in such a manner that the projection of said resilient member is spaced apart from said contact member when no external force is applied to said key top and that the projection of said resilient member engages the contact member when an external force is applied to said key top; and means for discharging air within the space defined by the recess and the resilient member.

40. A switch according to claim 39, wherein said discharging means is disposed along the internal surface of the recess.

41. A switch according to claim 39, wherein said discharging means includes a groove provided on the internal surface of the recess.

42. A switch according to claim 39, wherein the projection of said resilient member is surrounded by said urging means.

43. A push button switch comprising:

a key top adapted to be applied with an external force, said key top having a recess therein;

a resilient member covering the recess and projecting, adjacent the recess, in a direction opposite to the depth of the recess;

a projection extending from said resilient member in a direction opposite to the depth of the recess, at least an end of the projection being of conductive material;

the opening of the recess being of such dimension that at least a portion of the projection is passable through the opening;

a contact member secured to a base plate in opposed relationship with said projected portion; and means, disposed outwardly of said contact member, for urging said key top in such a manner that the projection of said resilient member is spaced apart from said contact member when no external force is applied to said key top and that the projection of said resilient member engages said contact member when an external force is applied to said key top.

44. A switch according to claim 43, wherein said resilient member has, around the recess, an extension through which the key top is urged by said urging means.

45. A switch according to claim 43, wherein said urging means surrounds said projection.

46. A switch according to claim 43, further comprising an insulating sheet disposed between said urging means and the base plate and having an opening at a position corresponding to the contact member.

47. A push button switch comprising:

a key top adapted to be applied with an external force, said key top having a recess therein;

a resilient member arranged to cover the recess, said resilient member having a projection extending therefrom in a direction opposite to the depth of the recess and beyond the opening of the recess, at least an end of the projection being of conductive material;

a contact member secured to a base plate in opposed relationship with said projected portion;

means, disposed outwardly of said contact member, for urging said key top in such a manner that the projection of said resilient member is spaced apart from said contact member when no external force is applied to said key top and that the projection of said resilient member engages the contact member when an external force is applied to said key top; and a resilient film arranged to seal the space surrounding said projection and said contact member, said film being disposed between said resilient member and the base plate.

48. A switch according to claim 47, wherein said urging means surrounds said projection.

49. A switch according to claim 47, wherein said film extends along the base plate, and said urging means is disposed between the extended portion of the film and said key top.

50. A push button switch comprising:

a key top adapted to be applied with an external force, said key top having a recess therein;

a conductive resilient member arranged to cover the recess, said resilient member having a projection of conductive material extending therefrom in a direction opposite to the depth of the recess and beyond the opening of the recess;

a plurality of contact members secured to a base plate in opposed relationship with said projected portion; and means, disposed outwardly of said contact member, for urging through said conductive resilient member said key top in such a manner that the projection of said resilient member is spaced apart from at least one contact member when no external force is applied to said key top and that the projection of said resilient member engages said at least one contact member when an external force is applied to said key top;

said urging means contacting at least one of the other contact members.

51. A switch according to claim 50, wherein said urging means surrounds said projection.

52. A switch according to claim 50, wherein said urging means includes a coil spring.

53. A switch according to claim 50, wherein said key top has a flange provided with an annular groove arranged to receive said resilient member, and wherein said urging means contacts said resilient member within said groove.

54. A push button switch comprising:

a key top;

a resilient member disposed below the key top and having a projection extending downwardly therefrom, said projection having conductive material on at least the bottom surface thereof, and said resilient member being disposed to provide a clearance between an upper portion thereof aligned with said projection and a downwardly exposed surface of said key top;

a base plate;

at least one electrically conductive contact member disposed on said base plate;

means for guiding said key top so that said conductive material is displaced therewith, said guiding means including a holding member having a hole through which said key top slidingly passes and further including means for retaining, in the absence of downwardly applied pressure upon said key top, said key top and said resilient member in a position whereat said conductive material does not maintain electrical contact with said contact member, said retaining means being outwardly disposed from said contact member;

said holding member being fixedly joined to said base plate so that said conductive material maintains electrical contact with said contact member upon the application of a predetermined downward pressure upon said key top.

* * * * *